US005477233A

United States Patent [19]

Hemming et al.

[11] Patent Number: 5,477,233

[45] Date of Patent: Dec. 19, 1995

[54] NOTCH MONOPOLE ANTENNA

[75] Inventors: Leland H. Hemming, Poway; John Glabe, Ramona; Curt Gibson, Spring Valley, all of Calif.

[73] Assignee: McDonnell Douglas Corporation, Huntington Beach, Calif.

[21] Appl. No.: 351,628

[22] Filed: Dec. 8, 1994

[51] Int. Cl.[6] ..... H01Q 13/10

[52] U.S. Cl. ..... 343/767; 343/770; 343/863

[58] Field of Search ..... 343/767, 770, 343/863, 725; H01Q 13/10

[56] References Cited

U.S. PATENT DOCUMENTS

| | | | |
|---|---|---|---|
| 3,007,164 | 10/1961 | Davis | 343/767 |
| 5,023,623 | 6/1991 | Kreinheder et al. | 343/770 X |
| 5,194,875 | 3/1993 | Lucas | 343/767 |

*Primary Examiner*—Donald T. Hajec
*Assistant Examiner*—Tho G. Phan
*Attorney, Agent, or Firm*—George J. Netter; John P. Scholl

[57] ABSTRACT

A notch antenna (10) has a metallic notch element (20) deposited on a dielectric substrate (12), which element has a smooth continuously curved edge located adjacent a substrate edge (18). A metallic ground plane (28) is located adjacent the substrate edge (18) spaced very closely to element 20 at one end and at a gradually increased spacing moving away from the one end. An electromagnetic field transmitting coaxial cable (30) with ferrite beads (44) received over its outer conductor for reducing spurious radiation is located on the opposite side of substrate (12,14). The cable center conductor (34) is connected to a metallic strip (38) that is located on the same side of substrate (12,14) as the coaxial cable and tracks the same path as the notch element (20) on the opposite side of substrate (12). The antenna (10) is fed by electromagnetic energy at the closely spaced region of the element (20) and ground plane (28).

13 Claims, 2 Drawing Sheets

Magnitude dB Vs. Azimuth

NOTCH MONOPOLE ANTENNA

BACKGROUND

1. Field of the Invention

The present invention relates to a broad band, broad beam, low profile ultra-high frequency antenna element, and, more particularly, to such an antenna element having an overall reduced antenna height while achieving a vertically polarized signal above a ground plane and maintaining the antenna gain.

2. Description of Related Art

Notch antennas typically are in the form of a planar arrangement with a pair of conductors flaring away from a common feed point along a so-called "notch". The curve of the two conductors flaring away from one another is typically exponential, but may be other mathematical curves, and the resulting antenna may be constructed to have a wide variation in desirable characteristics. Electromagnetic energy is provided to the base of the notch with appropriate sizing being provided for matching transmission line impedance. As to operation, the conductors flaring away from one another produces a gradual increase of the effective impedance between them until it matches the free space impedance at which time, the antenna conductors act like impedance matching transformers and result in launching of a radio frequency energy wave into the surrounding free space. Construction of such antennas can be desirably accomplished by the use of printed circuit materials which enables combining a large number of the antenna elements into arrays useful for a wide variety of special applications such as, for example, radio astronomy, electronic air defense systems, and radar.

For general background of such antennas, reference is made to the paper entitled "Endfire Slotline Antennas" presented at JINA 1990 Nice, France, 13–15 November by Daniel H. Schaubert. Reference is also made to pending application, Ser. No. 08/158,057 filed Nov. 24, 1993 for RESONATED NOTCH ANTENNA assigned to the same assignee as this present document in which a dipole endfire slot antenna is described.

Although the above-referenced known antennas are satisfactory under many circumstances, it is desirable to be able to achieve additional antenna gain, to reduce the height of the antenna, as well as maintain a vertically polarized antenna above a ground plane.

SUMMARY OF THE PRESENT INVENTION

In the practice of the present invention there is provided a notch antenna including an antenna conductor laid down on the major surface of a first insulative substrate which extends along a generally flaring path as measured from an edge of the substrate with a first end portion starting very closely spaced from the substrate edge and flaring continuously away from the edge until a relatively wide opposite end is reached at which electromagnetic energy can be launched or is received during reception mode. The lower edge of the substrate is mounted onto ground plane which consists of a conductive layer deposited upon either the surface of an object on which it is desired to mount the antenna or to a further circuit board substrate, for example, such that the ground plane and substrate for the antenna are arranged at generally 90° to one another.

Energization and interconnection with the antenna for transmission use is provided through a coaxial cable, the center connector of which interconnects with a deposited lead that extends along the opposite side of the insulative base from the antenna conductor and coextensive with the antenna conductor until it reaches the narrow spacing end of the antenna element at which time it crosses the gap and interconnects directly to the grounding plane. A plurality of ferrite beads are received over the coaxial cable for controlling low frequency currents and thereby enhancing efficiency of operation.

DESCRIPTION OF A PREFERRED EMBODIMENT

Figure 1:
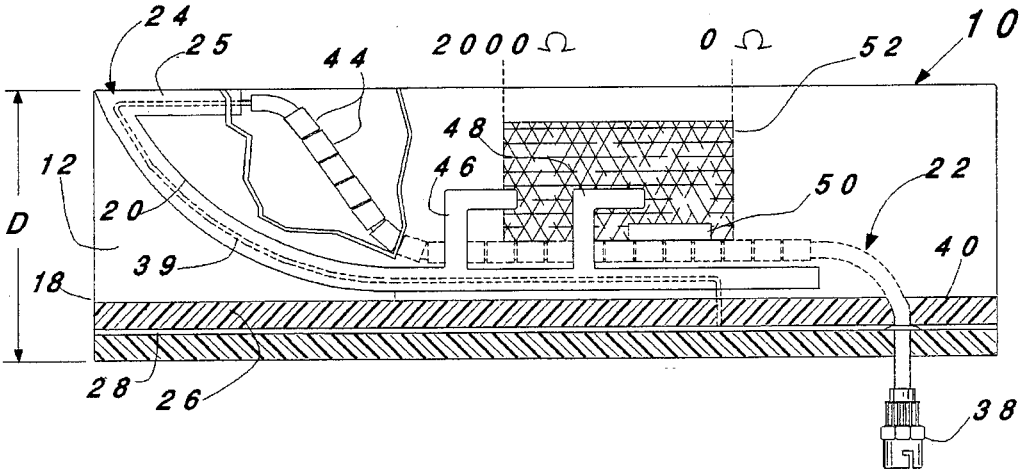
FIG. 1 is a side elevational view of the antenna of this invention.
Figure 3:
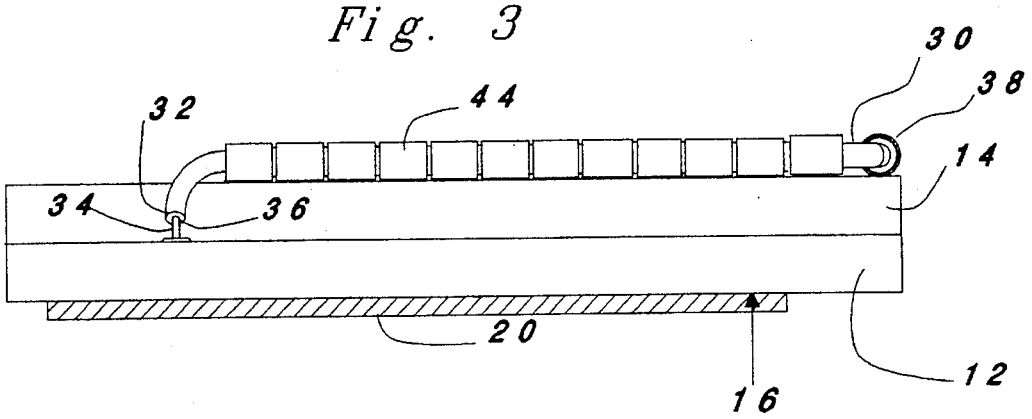
FIG. 3 is a top plan view of the antenna taken along the line 3—3 of FIG. 1.
Figure 4:
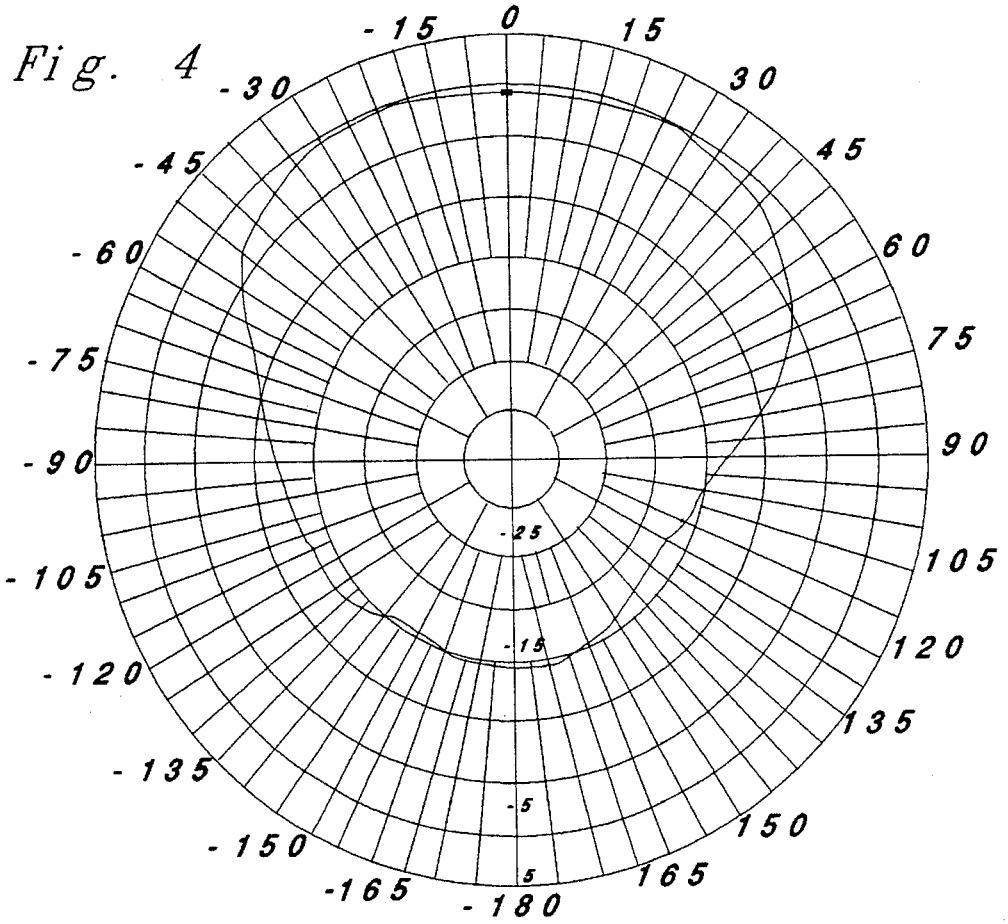
FIG. 4 is a graph of a radiation pattern of the described antenna.

Turning now to the drawing and particularly FIGS. 1 and 3, the antenna of the present invention is enumerated generally as 10. A pair of dielectric substrates 12 and 14 sandwiched together has first and relatively flat major surface 16 and a straightline edge 18. A metallic layer 20 is laid down on the dielectric substrate major surface 16 forming the antenna notch element and has a smooth, continuously curved edge located at one end 22 very close to the edge 18 and flaring away from the base edge 18 to a maximum spacing from the edge to element end 24. The element 20 extends rearwardly from the maximum flared end 24 to form a termination portion 25.

Edge 18 of the composite substrates 12 and 14 is affixed to a further dielectric substrate 26 major surface, the opposite surface of which has a metallic ground plane or strip 28 laid down thereon. Layer 20 and ground plane 28 can be made of copper formed by conventional circuit board techniques.

Electromagnetic energy is provided to the antenna in transmission mode via a coaxial cable 30 including an outer sheath 32 with a central conductor 34 spaced from the sheath by an insulative material 36. The energy entrance end of the cable passes through an opening in the ground plane and includes a conventional connector 38 at its terminal. The cable sheath 32 is electrically connected to the ground plane by solder at 40, for example.

The cable 30 extends to the end of 25 and with the sheath removed the cable central conductor 34 is electrically secured to a metallic strip 39 deposited on one of the facing substrate surfaces extending along and lying generally directly opposite to the element 20 centerline (FIG. 1). The outer end of the strip 39 extends away from the element 20 at a point located a predetermined distance d from the element end 22, passes through the dielectric substrate 26 and is connected to the ground plane at 42 (e.g., soldering).

A plurality of ferrite beads 44 are slidingly received on the coaxial cable 30 and absorb electromagnetic energy to reduce spurious radiation. These beads also enable the antenna to operate at a lower frequency than the antenna physical dimensions would otherwise permit. In this way the size of the antenna can be reduced for any particular operation frequency range.

As depicted in FIG. 1, first and second metallic reflectors 46 and 48 are deposited on dielectric base surface 16 interconnecting with and extending away from the metallic layer antenna element 20 in the narrow gap region. Also, immediately adjacent reflector 48 there is a deposited metallic stub tuning means 50. The major surface 16 in the region of the reflectors and stub tuning means includes a resistive layer 52 deposited thereon in accordance with known circuit board techniques. More particularly, the layer 52 exhibits a tapered resistance value varying from 2000 ohms at the forward edge to a maximum of approximately 0 ohms at its trailing edge. This tapered resistance serves to terminate the energy radiated rearward and improves the pattern front-to-back ratio.

Figure 2:
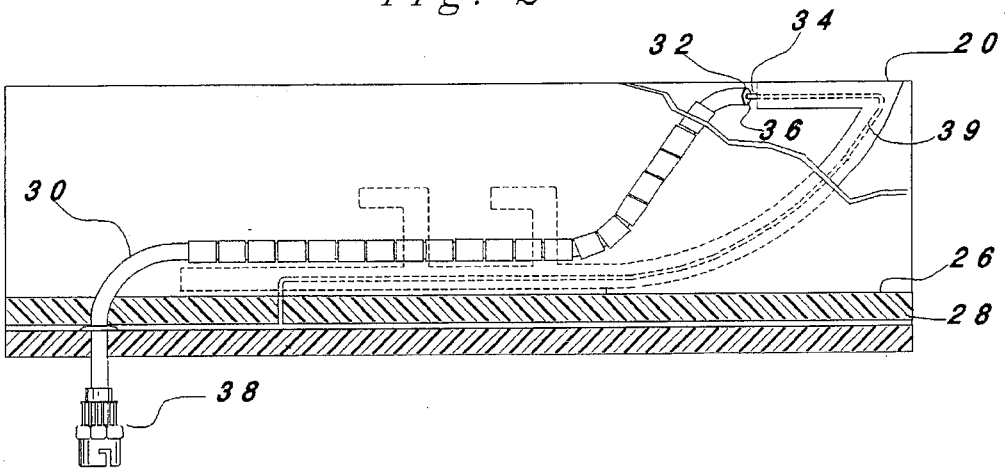
FIG. 2 is a rear elevational view of the invention of FIG. 1.

In an operational construction of the invention, the antenna element 20 was in the form of an exponential curve having a maximum opening dimension D=2.75 inches and an overall length of about 8 inches. The grounding plate or strip 28 width W was 0.125 inches (FIG. 2) and the coaxial cable sheath entrance end soldered to the strip with the connector 38 providing means for attachment to an RF transmission line (not shown). Although current antennas are narrowband (i.e., less than 10%), the described antenna has a greater than 3:1 impedance and pattern bandwidth. The antenna height D is on the order of 0.125 wavelength at the low end of the band as compared with conventional antenna heights in the order of 0.25 wavelength. A 12–15 decibel back-to-front pattern ratio has been demonstrated.

The operational theory of endfire notch antennas is not precisely known, however, it is believed operation is achieved by gradually changing the impedance of an RF transmission line (e.g., element 20) with respect to the air impedance. Electromagnetic energy to be transmitted is applied to the antenna by the 50-ohm coaxial cable 30 and is matched to the antenna impedance which is inherently 65-ohms by the tapered resistance transmission line 52, the central conductor of the cable being connected to the feed point adjacent the antenna element end 22. As the element/ground plane spacing approaches ¼ of the wavelength width, an electromagnetic wave is launched in the direction of the arrow from the notch which is the space between the grounding strip and element 20.

There is a tendency when operating at the low end of the band for currents to flow back over the coaxial cable producing undesirable radiation. The currents are controlled by the ferrite beads 44 which effectively confine the radiating currents to the forward parts of the antenna. It is this latter action which enables the described antenna to operate effectively below the ¼ wavelength range at the band low end.

If the antenna is to be used for reception, operation is essentially a reversal of that just described for transmission.

The ground plate or strip 28 not only serves to control impedance matching but also can serve as a direct bonding means to a mounting surface (e.g., aircraft surface).

Although the present invention has been described in connection with a preferred embodiment, it is to be understood that those skilled in the appertaining arts may effect modifications that come within the spirit of the invention as disclosed and within the ambit of the appended claims.

What is claimed is:

1. A notch monopole antenna, comprising:

a first metallic layer having a convexly curved edge including a first portion of slight curvature and a smoothly interconnecting second portion of substantially greater curvature;

a second metallic layer located spaced from the first layer curved edge forming the antenna notch therebetween, said notch varying from a closely spaced portion to a relatively widely spaced portion;

a transmission line means with an inner conductor, an outer conductor and insulation therebetween, said line means having one end for connection to a source of electromagnetic energy and another end;

a metallic strip interconnected with the transmission means inner conductor, said strip being formed into a curve identical to that of the first metallic layer with correspondingly curved portions of the strip and first layer being spaced from one another;

first means interconnecting the transmission means inner conductor other end to the second metallic layer adjacent the first slightly spaced portion of the first metallic layer; and second means interconnecting the transmission means outer conductor to the second metallic layer adjacent to and outwardly of the first interconnecting means.

2. A notch monopole antenna as in claim 1, in which reflector means are located in the region of the closely spaced notch portion.

3. A notch monopole antenna as in claim 1, in which ferrite beads are received in surrounding relationship on the transmission line means.

4. A notch monopole antenna as in claim 2, in which a tapered resistance is located effectively adjacent the reflector means.

5. A notch monopole antenna as in claim 1, in which each of the first and second means interconnecting the transmission line means inner and outer conductors respectively to the second metallic layer includes a solder body.

6. A notch monopole antenna, comprising:

a first dielectric substrate having first and second major opposite surfaces and an edge therebetween;

a first elongated metallic layer deposited on the substrate first major surface having a continuously curved edge flaring away from the substrate edge and being closely spaced to the substrate edge at one end of the first layer and relatively widely spaced from said substrate edge at a first layer other end;

a second dielectric substrate secured to the edge of said first substrate;

a conductive ground plane deposited on an outer surface of the second substrate;

transmission line means with first and second ends having an outer conductor, an inner conductor and an insulating material therebetween;

a first end of the transmission means having its outer conductor electrically connected to the ground plane outwardly of the first metallic layer other end;

a metallic strip deposited on the first dielectric substrate spaced from the first metallic layer and curved to correspond to the curve of the first metallic layer; and the second end of the transmission line means inner conductor being electrically connected to the metallic strip adjacent the first metallic layer other end.

7. A notch monopole antenna as in claim 6, in which the first dielectric substrate includes first and second dielectric sheets secured into a composite form with the metallic strip therebetween, and the first metallic layer is deposited on an outer surface of the composite form.

8. A notch monopole antenna as in claim 7, in which a pair of conductive reflector means and a tuning stub means are deposited on the same outer surface of the composite form as the first metallic layer and electrically connected to said first metallic layer.

9. A broad band, broad beam notch monopole antenna, comprising:

dielectric substrate means having first and second major opposite surfaces with an edge surface therebetween;

a metallic layer on the first major surface of the dielectric substrate means having a convexly curved edge facing the substrate means edge, said metallic layer curved edge including a first portion of relatively slight curvature spaced relatively close to the substrate means edge and a second portion of relatively large curvature spaced at a correspondingly greater distance from the substrate means edge;

a conductive ground plane fixedly mounted to the substrate means edge surface and lying opposite the first and second metallic portions edge;

transmission line means having an outer conductor and an inner conductor with insulation therebetween;

a plurality of ferrite beads received in surrounding relationship about the transmission line means outer conductor;

a metallic strip on the dielectric substrate second major surface extending along a path corresponding to the curve of the metallic layer edge and generally parallel thereto;

a first end of the transmission line means outer conductor being connected to the ground plane adjacent the metallic layer first curved edge portion; and a first end of the transmission line means inner conductor being connected to an end of the metallic strip adjacent the metallic layer second curved edge portion and a second end of the strip being connected to the ground plane adjacent the metallic layer first curved portion.

10. An antenna as in claim 9, in which first and second reflector means are deposited on the dielectric substrate means first surface immediately adjacent the metallic layer curved edge first portion.

11. An antenna as in claim 10, in which a tapered resistance is deposited onto the dielectric substrate means first surface encompassing the first and second reflector means.

12. An antenna as in claim 11, in which the tapered resistance varies in value from approximately 2000 ohms to 0 ohms.

13. An antenna as in claim 9, in which the dielectric substrate means includes first and second dielectric sheets secured into a composite form with the metallic strip therebetween, and the metallic layer is deposited on an outer surface of the composite form.

* * * * *